United States Patent [19]

Cocco et al.

[11] Patent Number: 4,469,425

[45] Date of Patent: Sep. 4, 1984

[54] PHOTOGRAPHIC FILM PROCESSING APPARATUS

[75] Inventors: Vincent L. Cocco, Wakefield; Philip R. Norris, North Reading, both of Mass.

[73] Assignee: Polaroid Corporation, Cambridge, Mass.

[21] Appl. No.: 493,014

[22] Filed: May 9, 1983

[51] Int. Cl.[3] ..... G03D 3/10

[52] U.S. Cl. ..... 354/310; 354/316; 354/320

[58] Field of Search ..... 354/310, 311, 312, 315, 354/316, 320, 321, 322

[56] References Cited

U.S. PATENT DOCUMENTS 2,852,993 9/1958 Applegate ..... 354/344
3,288,609 11/1966 Land et al. .
3,405,617 10/1968 Land et al. .
3,405,618 10/1968 Land et al. .
3,565,519 2/1971 Land .
3,943,539 3/1976 Bown et al. .
4,361,392 11/1982 Hutchison .

*Primary Examiner*—A. A. Mathews
*Attorney, Agent, or Firm*—John S. Vale

[57] ABSTRACT

A processing apparatus is provided for immersion treating a sheet-like film unit with a processing liquid and thereafter squeegeeing excess liquid therefrom. The apparatus includes a processing tank holding a supply of liquid, a pair of pressure applying rollers for withdrawing the film unit from the tank and squeegeeing excess liquid therefrom, a movable film carrier for supporting the film unit at a processing position in the liquid and then raising the film unit to position where it feeds an end of the film into the rollers, and means responsive to rotation of the rollers for automatically moving the carrier from the processing position to the film feed position.

18 Claims, 9 Drawing Figures

PHOTOGRAPHIC FILM PROCESSING APPARATUS

BACKGROUND OF THE INVENTION

The present invention relates to the field of photography and, more specifically, to processing apparatus for treating a sheet-like film unit with a low viscosity processing liquid by immersing the film unit in the liquid for a desired processing interval and then removing it therefrom.

The present invention focusses on immersion treating an exposed self-developing film unit with an aqueous alkaline processing liquid to initiate a development and diffusion transfer process. Typically, this type of self-developing film unit is aimed at the commercial and industrial photography market and generally is provided in the larger formats (4×5 and 8×10) for use in view cameras and the like. However, it will become apparent later that the processing apparatus is not limited in its use to this particular application, but also may be used for a variety of photographic immersion processes including developing, fixing and washing conventional photographic media.

The prior art is replete with processing apparatus for facilitating immersion treatment of a sheet-like film unit. Typically, such apparatus includes a container or tank holding a supply of processing liquid, means for locating the film unit at a submerged treatment position within the tank, and means for withdrawing the wet film unit from the tank while simultaneously squeegeeing or otherwise removing excess liquid therefrom.

While commonly assigned U.S. Pat. Nos. 3,405,617; 3,405,618; and 3,565,519 disclose examples of self-developing cameras that include immersion processing apparatus which are built into the light-excluding environment of the camera housing, thereby permitting direct transfer of the film unit from the exposure position into the liquid container, the processing apparatus embodying the present invention is a stand-alone device for receiving a film unit that has previously been exposed in a separate camera.

Generally, stand-alone immersion processes known in the prior art are designed to be used in a photographic darkroom where the exposed film unit may be safely removed from a holding cassette for transfer to the processing apparatus without concern about fogging by actinic light.

Representative examples of such immersion type film processes may be found in commonly assigned U.S. Pat. No. 3,288,609 and U.S. Pat. Nos. 3,943,539 and 4,361,392.

The first two of these patents disclose processes that are designed to immersion treat a single sheet film unit while the processor disclosed in the last-mentioned patent is configured to treat an exposed negative sheet and thereafter bring it into superposition with a dry positive image-receiving sheet.

Each of these processes utilize a pair of pressure applying rollers to advance the wet film unit out of the tank while applying a compressive pressure thereto to squeegee excess liquid from the treated film unit.

In U.S. Pat. No. 3,943,539, the same rollers also are used to feed the film unit into the tank initially. While the film unit is submerged in the liquid, one end of the film is retained between a lower set of rollers so the film may be retrieved after immersion treatment. If the submerged film unit should somehow slip out of the grasp of the rollers, the operator is obliged to manually raise a film carrier in the tank to feed the upper end of the film unit into the bite of the rollers before it can be withdrawn.

In the processors disclosed in U.S. Pat. No. 4,361,392, the exposed film unit is removed manually from its holding cassette placed on a processor loading ramp and advanced into the tank to locate it at a submerged processing position. The dry image receiving sheet is placed on a sliding tray above the tank. After a suitable processing interval, the operator must manually rotate the exit rollers with a hand crank and simultaneously manually advance a rake device which pushes the wet film unit and the dry image receiving sheet into the bite of the exit rollers.

These prior art immersion processes have several drawbacks that tend to inhibit efficient film processing. The need to take exposed film to a photographic darkroom for processing and having to manually unload the film from the cassette for transfer into the processing apparatus imposes burdonsome constraints on time and also tends to limit mobility. Some of these prior art processing apparatus require more manual manipulation (e.g., rotating the exit rollers while at the same time actuating the film pushing rake to feed the film into the rollers) than is desirable. Also, some of the prior art processes are mechanically complex and therefore relatively expensive.

Therefore, it is an object of the present invention to provide a simply constructed, easy to use, and relatively inexpensive processing apparatus for immersion treating a sheet-like film unit with a processing liquid.

It is another object to provide such a processing apparatus that is configured for daylight or ambient light operation, thereby eliminating the need for it to be operated in a photographic darkroom environment.

Yet another object of the invention is to provide a film holding cassette which is configured to cooperate with structure on the processing apparatus for easily transferring the film unit into the processing liquid without the operator having to manually handle the film unit.

Still another object of the invention is to provide an immersion processing apparatus which is configured to automatically feed the film unit from a submerged treatment position into the bite of a pair of exit pressure applying rollers in response to rotatably driving the rollers, thereby eliminating any requirement for the operator having to effect such film feed manually.

Other objects of the invention will, in part, be obvious and will, in part, appear hereinafter.

SUMMARY OF THE INVENTION

The present invention provides a simply constructed and easy to use processing apparatus for immersion treating a film unit with a processing liquid and thereafter removing excess liquid from the treated film unit.

The processing apparatus includes a processing tank configured to be filled with a volume of processing liquid sufficient to allow such a film unit to be immersed in the liquid for treatment. A pair of rotatable pressure applying rollers are mounted above the level of the liquid in the tank and are adapted to have the treated film unit advanced therebetween for removing the film unit from the tank and for squeegeeing excess liquid therefrom.

A film support member or carrier is located in the tank for movement between a first position where it receives a film unit inserted into the tank and supports it at a submerged immersion treatment position within the liquid, and a second position where it locates an end of the treated film unit above the level of the liquid and feeds it into the bite of the rollers.

The apparatus is also provided with means responsive to rotating the rollers in a direction to advance the film unit therebetween for effecting movement of the film support member from the first position to the second position to feed the liquid treated film unit into the rollers.

Preferably, the tank includes a top opening through which the film unit is inserted into and removed from the tank. The rollers are preferably mounted for movement between an inoperative position wherein the rolls are out of alignment with the opening to facilitate insertion of the film unit therethrough and an operative position wherein the rolls are in alignment with the opening to receive a liquid treated film unit for withdrawal and squeeging.

The processing apparatus is designed for daylight or ambient light operation when used with an optional compatible cassette. Preferably, the film unit is provided in a light-tight cassette of this type prior to insertion into the tank. In the illustrated embodiment, this cassette may be mounted on the back of a view camera for exposing the film unit held therein. The processing apparatus includes means at the opening for receiving the end of the cassette in light-tight relation with respect to the opening. That is, once the cassette is inserted into the opening, the processing apparatus provides the light excluding environment that permits daylight operation. Preferably, the apparatus includes a set of pins which are inserted into complementary openings in the cassette for opening a light-tight seal on the end of the cassette permitting the film unit to be advanced therethrough into the liquid filled tank. In the illustrated embodiment, the cassette includes a slider or pick for advancing the film unit from the cassette into the processing tank.

BRIEF DESCRIPTION OF THE DRAWINGS

For a fuller understanding of the nature and objects of the invention, reference may be had to the following detailed description taken in connection with the accompanying drawings wherein.

DESCRIPTION OF THE PREFERRED EMBODIMENT

Figure 1:
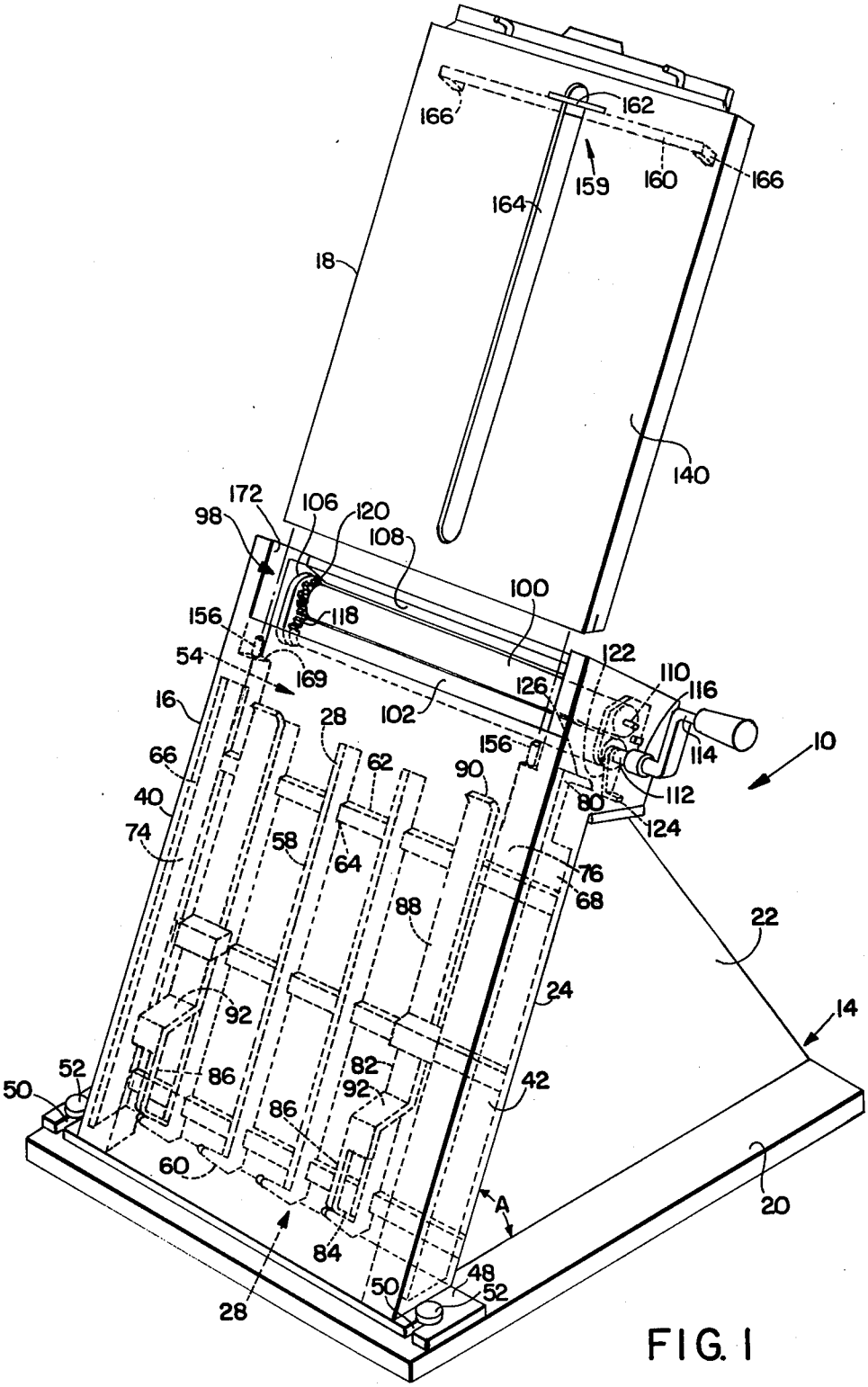
FIG. 1 a perspective view of a film processing apparatus embodying the present invention prior to loading a film unit thereinto.
Figure 2:
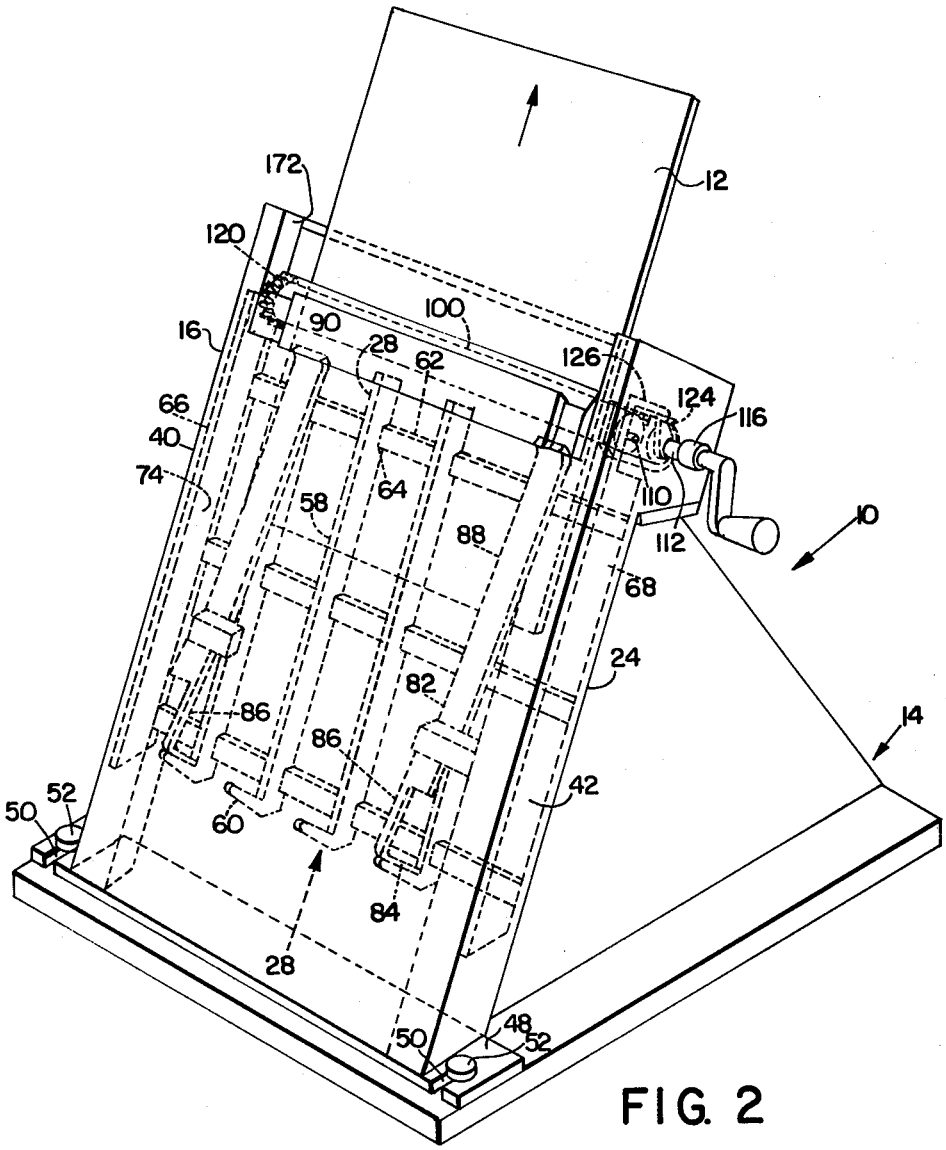
FIG. 2 is similar in some respects to FIG. 1 but shows a treated film unit being withdrawn from the apparatus.

FIGS. 1 and 2 show a perspective view of a processing apparatus 10 for immersion treating a sheet-like photographic film unit 12 with a low viscosity (e.g., similar to water) processing liquid for a desired processing interval and, thereafter for removing or squeegeeing excess liquid from the treated film unit.

Apparatus 10 includes a base or support member 14, a container or liquid holding tank 16 supported by base member 14 and having mounted or supported thereon various film manipulation components (to be described in detail later); and an optional light-tight film holding cassette 18.

As will become apparent later, cassette 18 is configured to plug into a top opening in tank 16 and form a light-tight seal therebetween. Advantageously, this type of construction allows daylight operation of processor 10. That is, when cassette 18 is attached to tank 16, these two components cooperate to define a light excluding structure within which the film unit 12 may be transferred from cassette 18 into the processing liquid in tank 16 without concern about the film being fogged by ambient light. Thus, there is no requirement for processing to take place in a photographic darkroom allowing the processor 10 to be set up close by the camera in which the film unit 12 is to be exposed. This is especially convenient when film unit 12 is of the self-developing type in that the photographer may view the finished photograph within minutes after exposure.

However, it should be understood that in the interest of lowering the selling price of this system, processor 10 may be marketed without optional cassette 18. In this case, processor 10 comprises base member 14 and tank 16 for use in a photographic darkroom or other actinic light excluding environment. If cassette 18 is not used, the exposed film unit 12 would be manually inserted into tank 16. At a later date, if the consumer wishes to upgrade the processor for daylight operation, the optional cassette 18 may be purchased separately.

In the illustrated embodiment, the base member 14 comprises a horizontal base plate 20, designed to rest on a processor support surface such as a table or desk top, and an upstanding support member 22 having a rearwardly sloping front face 24 against which a rear wall of tank 16 rests for supporting the tank 16 at an angle A (approximately 60° to 80°) with respect to horizontal base plate 20. As will become apparent later, it is preferable that tank 16 be tilted back slightly from the vertical position so that when a film unit 12 is inserted into the liquid within the tank, the force of gravity will cause it to preferentially assume its correct position on a later to be described movable film carrier 28 in tank 16. Although the illustrated support member 22 is shown to have a four-sided polygon longitudinal cross section, processor 10 may be alternatively constructed utilizing various other types of support members known in the art which function to maintain tank 16 at a rearwardly sloping angle, such as angle A, with respect to the horizontal base plate 20.

The tank 16 is formed of any suitable light opaque material that is compatible (substantially non-reactive) with the processing liquid. For example, if the processing liquid is an aqueous alkaline developing solution, the wall structure of tank 16 may be formed from a non-reactive plastic material such as polyvinylchloride (PVC).

Processor 10 may be used to immersion treat a variety of photographic media including conventional photographic film and paper and self-developing film.

For the purposes of illustration, it will be assumed that film unit 12 is an integral type of self-developing film unit including in its single sheet multilayer structure one or more photosensitive layers and an image-receiving layer. Following exposure to record a latent image in the photosensitive layer (or layers) the film unit 12 will be processed by immersing it in an aqueous alkaline processing liquid for a specified processing interval to initiate a development and diffusion transfer process. For a representative example of such a black-and-white film unit that is treated with an aqueous alkaline processing liquid which may include a silver halide developer, see commonly assigned U.S. Pat. No. 3,578,450. For a representative example of a multilayer structure of a color self-developing film unit wherein an aqueous alkaline processing liquid reacts with dye developers in the film structure, see commonly assigned U.S. Pat. No. 3,701,656. Another example of the type of color self-developing film unit and processing liquid which may be used with processor 10 is disclosed and claimed in commonly assigned copending application U.S. Ser. No. 492,731 entitled "Diffusion Transfer Film Unit" filed by F. Richard Cottrell on even date herewith.

Figure 3:
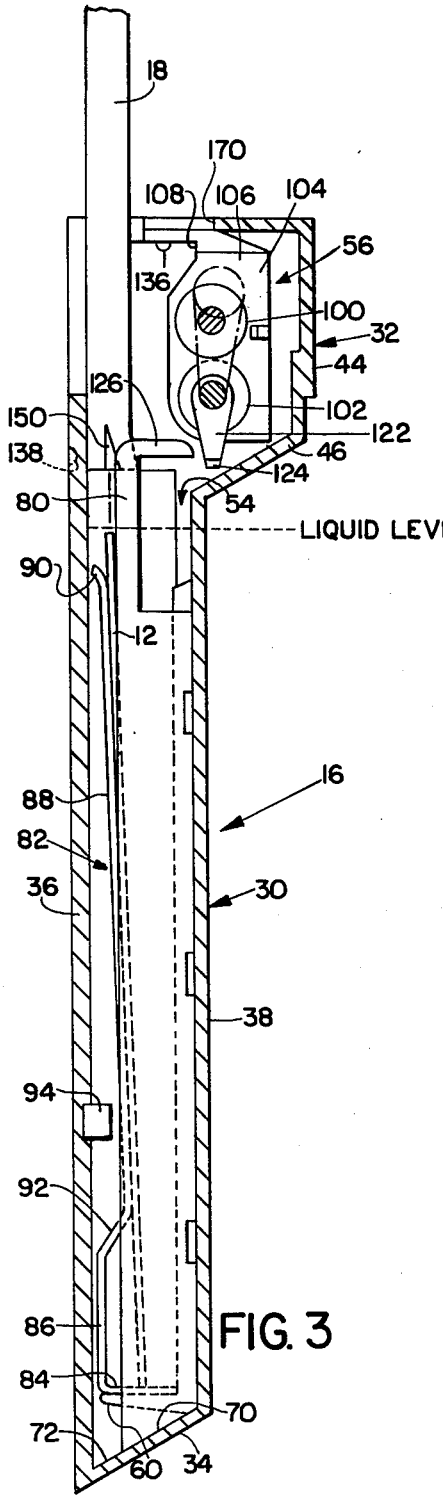
FIG. 3 is a cross-sectional view of a processor tank with its components arranged to receive a film unit.

As best shown in FIGS. 1, 2 and 3, tank 16 comprises a relatively narrow (measured longitudinally) lower liquid-holding portion 30, and an integrally formed wider upper mouth portion 32. This structure is formed by a plurality of planar tank walls including an angled bottom wall 34, a forward wall 36, an opposite spaced rear wall 38 of lower portion 30, a pair of oppositely spaced side walls 40 and 42, a rear wall 44 of the upper mouth section 32, spaced further back from front wall 36 than the lower portion rear wall 38, an angle transition wall 46 extending from the lower edge of wall 44 to the upper edge of rear wall 38, and a short top wall 47 extending between side walls 40 and 42 and projecting forwardly from rear wall 44 part way across the top of mouth portion 32.

In the illustrated embodiment, tank 16 includes an optional planar base plate 48 (see FIGS. 1 and 2), having a pair of slots 50 therein near its lateral margins, attached to the exterior of bottom wall 34 for releasably securing tank 16 to the base plate 20 by means of a pair of cap screws 52 which extend through the corresponding slots 50 and are received in complementary threaded holes (not shown) in base plate 20. Thus, in the illustrated embodiment, tank 16 is removably mounted on base member 14. Alternatively, tank 16 may be permanently attached to base member 14 if desired. Removably mounting tank 16 makes it more convenient for cleaning its various components when necessary. Also, tank 16 may be provided without the later to be described film manipulating structure permanently mounted thereon. In this case, tank 16 could be prefilled with the processing liquid at the factory and temporarily sealed to prevent leakage. Then, tank 16 may be sold as a disposable unit which is to be discarded after the processing liquid therein is expended.

The liquid holding lower portion 30 has a generally rectangular cross-section depthwise and is open at its top or upper end 54 which is located at the bottom of the communicating hollow mouth portion 32. Portion 30 is adapted to be filled with the processing liquid up to the liquid level indicated by a dotted line in FIG. 3.

Located in portion 30 is the previously noted film carrier 28 which is movable between a first position, shown in FIGS. 1 and 3, where it is fully inserted into lower portion 30 for receiving and supporting a film unit 12 at a submerged treatment position, and a second or raised position, shown in FIGS. 2 and 4, for raising the liquid treated film unit 12 so that its leading or upper end is fed into engagement with a later to be described roller assembly 56 mounted in mouth portion 32.

Film carrier 28 is an open lattice structure formed of any suitable materials that are non-reactive with the processing liquid. In the illustrated embodiment, carrier 28 includes vertically disposed film support members 58, each terminating at its lower end in a forwardly extending film supporting foot 60 projecting towards forward wall 36, that are interconnected by means of three vertically spaced horizontal connecting members 62 having appropriate notches 64 therein for securely receiving the rear portions of corresponding film support members 58.

Attached to the outboard ends of connecting members 62 are a pair of vertically disposed carrier guide and locating members 66 and 68. Member 66 is parallel to and in closely adjacent sliding relation to the interior surface of side wall 40 while the opposite member 68 is disposed in the same relationship to its corresponding side wall 42.

Each member 66 and 68 terminates at its lower end in an angled surface 70 that conforms to the angled interior surface 72 of bottom wall 34 and rests thereagainst to define the fully inserted first position of carrier 28.

Mounted on the interior surface of forward wall 36, near side walls 40 and 42, are a pair of vertically disposed guide blocks 74 and 76 that define a pair of vertically disposed guide channels adjacent corresponding side walls 40 and 42 for slidably receiving a corresponding guide and locating members 66 and 68. This structure locates carrier 28 laterally within lower portion 30. The guide blocks 66 and 68 extend rearwardly toward rear wall 38, but terminate just short thereof to allow the connecting member 62 to slide therebetween. This establishes the correct fore and aft location of carrier 28 within lower portion 30 whereby the rearwardmost surfaces of connecting members 68 slide along the interior surface of rear wall 38.

The guide and locating member 68, on the right hand side of carrier 28 as viewed in FIGS. 1 and 2, also includes on its upper end an integrally formed, upwardly projecting, and rearwardly extending hook member 80 thereon, the function of which will become apparent later.

In the illustrated embodiment, carrier 28 also includes a pair of vertically disposed resilient film engaging arms 82 attached to the foot portions 60 of the two outermost members 58.

As shown in the drawings, each arm 82 includes a narrow lower horizontal foot 84 secured, by any suitable means, to the foot 60 of corresponding member 58. Extending upwardly from foot 84 is a narrow section 86 which is followed by a wider (approximately 0.75 inches) main arm portion 88 that terminates in a turn back upper end portion 90. Main arm portion 88 includes an offset along its length formed by a rearwardly sloping angled cam follower section 92 that is adapted to engage a corresponding cam block 94 mounted on the interior of wall 36 in the upward path of travel of cam follower 92.

As best shown in FIG. 3, when carrier 28 is fully inserted in lower portion 30, the cam followers 92 are below and do not engage cams 94. Thus, resilient arms 82 are in a non-stressed normal position wherein the upper ends of arms 82 tilt back against forward wall 36. This provides maximum spacing between arms 82 and the carrier members 58 for easy insertion of a film unit 12 therebetween into the processing liquid in lower portion 30. When so inserted, normally gravity will cause the film unit 12 to lie substantially flat against the members 58 with its upper leading end in alignment with the bite between a pair of later to be described rollers on assembly 56 because of the rearward tilt of tank 16. However, it has been observed that some types of film units tend to curl after being submerged in the processing liquid.

Resilient arms 82 are provided to counter this tendency to curl. As best shown in FIG. 4, when carrier 28 is raised to feed the film into roller assembly 56, the cam followers 92 engage cams 94 and cause the resilient arms 82 to deflect rearwardly so that the free upper ends of arms 82 engage and push the upper end of film unit 12 against the corresponding member 58 thereby assuring that the film is aligned with the bite of the rollers. When carrier 28 is once again returned to its fully inserted position, the followers 92 are disengaged from cams 94 allowing the resilient arms 82 to return to the normal unstressed position of FIG. 3.

The width of carrier 28, as measured between the interior lateral surfaces of guide blocks 74 and 76, is slightly wider than the width of film unit 12 to be inserted therebetween. When carrier 28 is fully inserted into lower portion 30, the horizontal feet 60 are at a depth such that the film unit 12 supported thereon is fully submerged in the processing liquid which fills the lower portion 30 up to the liquid level denoted by the dotted line in FIG. 3.

Figure 4:
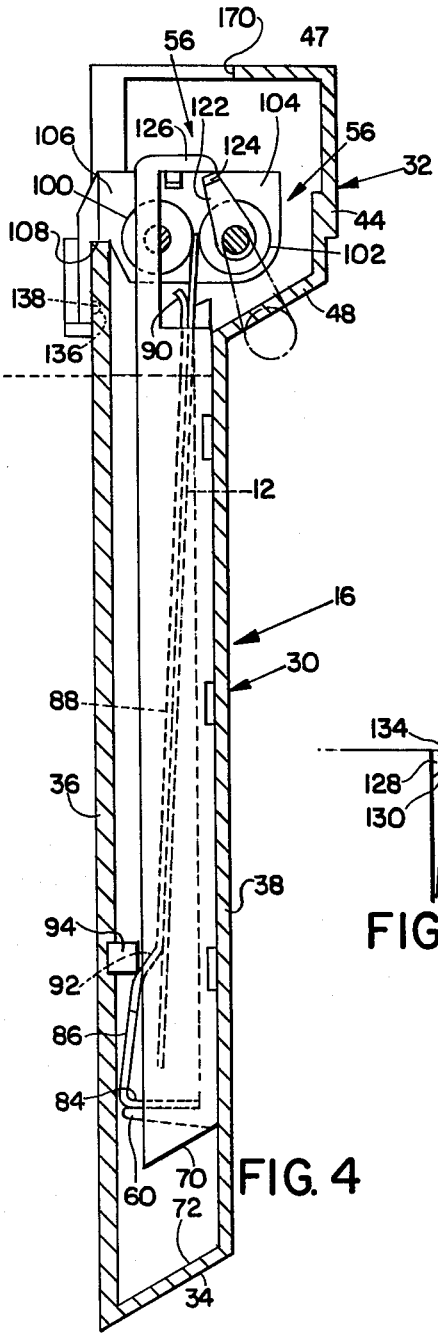
FIG. 4 is a cross-sectional view of the processor tank showing its components in a film withdrawal mode.

The upper hollow mouth portion 32 of tank 16 has roller asembly 56 mounted therein for pivotal movement between an inoperative raised position, shown in FIGS. 1 and 3, where assembly 56 is out of alignment with the upper opening 54 of tank lower portion 30 to allow unimpeded insertion of a film unit 12 into the processing liquid, and an operative lowered position, shown in FIGS. 2 and 4, above the liquid wherein assembly 56 is aligned with open end 54 for receiving a treated film unit 12 advanced thereinto from lower portion 30.

Assembly 56 comprises a pair of juxtaposed pressure applying rollers 100 and 102 rotatably mounted in a frame 104 which, in turn, is pivotally mounted in mouth portion 32 for movement between the raised and lowered positions.

Frame 104 comprises a pair of oppositely spaced lateral end plates 106 that are connected together by a laterally extending crossbar 108. The upper or forward roller 100 is fixed on an axial shaft 110 which has its opposite protruding ends rotatably supported in appropriate bearings in end plates 106. The lower or rear roller 102 is fixed to an axial shaft 112 that has its opposite protruding ends passing through holes in plate 106 and then extending through aligned bearing holes in the tank side walls 40 and 42. In this manner, assembly 56 is mounted for pivotal movement, about shaft 112, between its raised and lowered positions.

Outboard of side wall 42, the protruding end of shaft 112 is connected to a crank handle 114 by means of a mechanical coupling 116. The rollers 100 and 102 are rotatably connected together for simultaneous counter-rotation by means of a drive gear 118 on the end of roller 102 opposite crank handle 114 and a gear 120 on roller 100 which is in mesh with gear 118. In an alternative embodiment, the crank handle 114 may be replaced by a motorized drive for rotating shaft 112.

The roller assembly 56 also includes means, in the form of an L-shaped member or crank 122 keyed to shaft 112, responsive to driving of the rollers for advancing or raising the film carrier 28 from its first position shown in FIGS. 1 and 3 to its second position shown in FIGS. 2 and 4.

Crank 122 is located on shaft 112 between side wall 42 and the facing end plate 106. Assume for the moment that a film unit 12 is submerged in the liquid in lower portion 30. To extract the film unit 12, roller assembly 56 is manually moved from the inoperative position of FIG. 3 to the operative position of FIG. 4.

The crank 122 has a foot portion 124 which has a circular path of travel that intersects the rearwardly extending finger 126 of carrier hook 80. In response to the operator manually turning crank handle 114 in a clockwise direction, the crank foot 124 sweeps under and engages hook finger 126. As crank 122 continues to rotate with shaft 112, it pushes hook 80 upwardly, thereby raising the film carrier 28.

Figure 5:
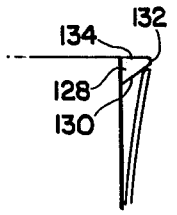
FIG. 5 is a diagrammatic representation of a film carrier latching arrangement.

As best shown in FIG. 5, the adjacent end plate 106 has an outwardly protruding latch member or detent 128 that extends into the upward path of travel of the hook finger 126. The underside of detent 28 includes a ramp-like angled cam surface 130 which is engaged and followed by the upper surface of finger 126. The hook 80 is somewhat resilient and it flexes outwardly (towards side wall 42) as it follows cam surface 130. When finger 126 finally clears the outboard end 132 of detent 128, hook 80 automatically returns to its unstressed state locating the underside surface of finger 126 directly over the top flat detent surface 134. By this time, the crank foot 124 has reached its highest position and it slides out from under finger 126 leaving hook 80 latched onto detent 128 (see FIG. 4) so that film carrier 28 cannot fall back to its first or lower position.

When raised in this manner, carrier 28 feeds the leading end of film unit 12 into the bite of the rollers which continue to be rotated to advance the film unit therebetween. As the film unit 12 is withdrawn in this manner, rollers 100 and 102 apply sufficient compressive pressure to the film unit to squeegee excess liquid therefrom.

Following this processing step, the roller assembly 56 is manually moved to its raised position. This causes the detent 128 to slide out from under hook finger 126 so that the film carrier 28 is free to fall back down into its first position under the influence of gravitational force.

When roller assembly 56 is pivoted down to its operative position, that portion of cross bar 108 extending forwardly of side plates 106 overlies the upper end of forward wall 36, as best shown in FIG. 4 in a protrusion or detent on its interior surface, as suggested at 136, snaps into a conforming recess 138 in the exterior of wall 36. In this manner, the roller assembly 56 is releaseably latched in the down or operative position to resist upward rotation which may occur as a result of a clockwise moment force applied thereto when the crank handle 114 is rotated in the clockwise direction to drive the rollers.

Figure 6:
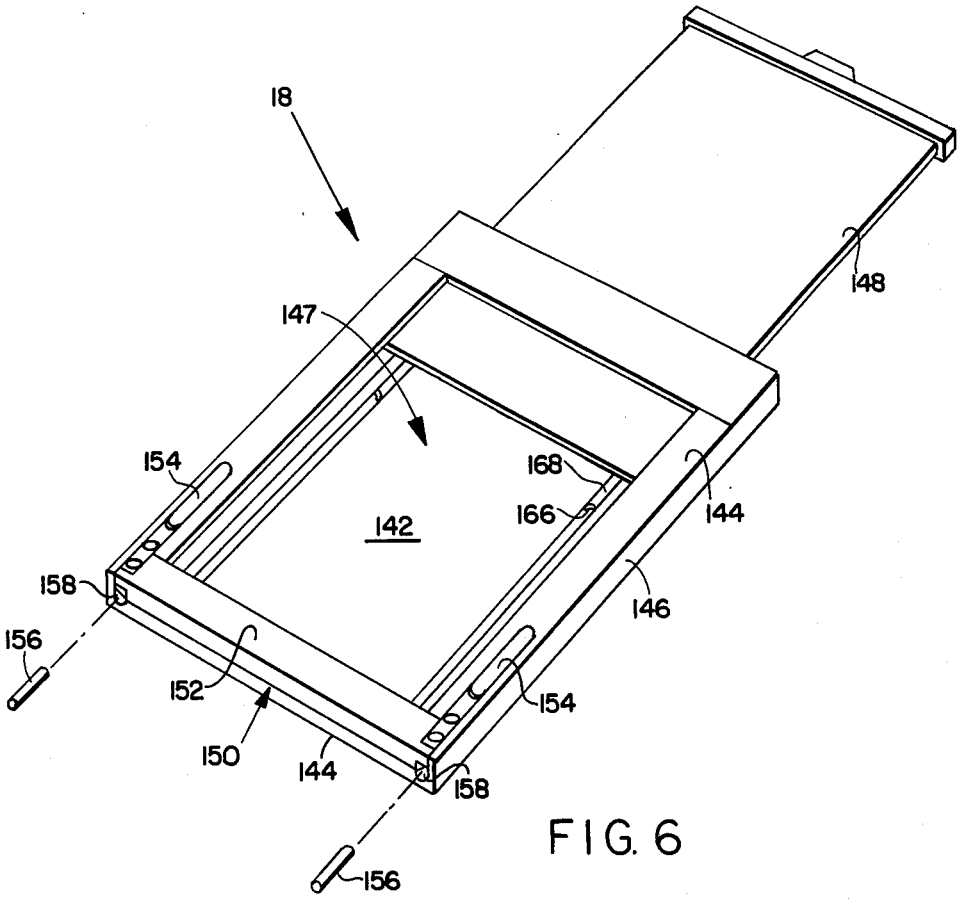
FIG. 6 is a perspective view of a film holding cassette adapted to be inserted into the top end of the processor tank.

As best shown in FIGS. 1 and 6, the film holding cassette 18 is a thin, boxlike structure formed of light opaque material. It includes a rear wall 140 having an interior surface 142 for supporting a film unit 12 thereon at an exposure plane. A forward cassette wall 144, spaced from rear wall 140 by an intermediate peripheral section 146, has an exposure aperture 147 therein that is selectively blocked and unblocked by moving a conventional dark slide 148 between opened and closed positions in a known manner.

A variable geometry film entry and withdrawal slot 150 is provided at the leading end of cassette 18 between the fixed bottom wall 140 in a movable laterally extending section 152 of forward wall 144 which is attached to the fixed main portion of forward wall 144 by a pair of longitudinally extending leaf springs 154.

In the normal unstressed state, springs 154 hold section 152 close to the rear wall surface 142 to close slot 150. The facing interior surfaces defining slot 150 preferably are covered with light trapping pile material so that slot 150 is light-tight. Slot 150 is opened to facilitate film insertion and withdrawal by urging section 152 away from rear wall 140 against the bias of the leaf springs 154.

In the illustrated embodiment, this may be accomplished by introducing a pair of wedge pins 156 into a pair of tapered pin receiving cam slots 158 at the lateral edges of slot 150. To open slot 150 for loading a film unit 12 into cassette 18, the pins 156 may be mounted on a film loading fixture located in a photographic darkroom. In the illustrated embodiment, processor 10 includes a pair of wedge pins 156 extending upwardly from the top of the previously noted guide blocks 74 and 76. When cassette 18 is inserted into the forward end of mouth portion 32, as shown in FIG. 3, these pins 156 are received in cam slots 158 to open a film entry and withdrawal slot 150 so that film unit 12 may be advanced therethrough into the tank lower portion 30.

Cassette 18 preferably includes a sliding pick mechanism 159 is configured to engage the trailing end of the film unit 12 located at the exposure position and advance it forwardly through the open slot 150.

As best shown in FIG. 1, pick mechanism 159 slides in an internal chamber within rear wall 140 between its exterior and interior surfaces. Slide mechanism 159 includes a cross bar 160 having a centrally disposed push tab 162 thereon that protrudes out of cassette rear wall 140 through a longitudinally extending access slot 164 disposed along the path of travel of cross bar 160. The ends of cross bar 160 are bent at right angles to the cross bar to form a pair of oppositely spaced pick fingers 166 extending to the interior of cassette 18. As best shown in FIG. 6, fingers 166 ride in a pair of corresponding longitudinally extending guide channels 168 that extend through rear wall 140 to the film support surface 142. The tips of fingers 166 protrude above surface 142 in position to engage the trailing edge of a film unit 12 located at the film plane.

Once cassette 18 is mounted on processor 10 to open slot 150, the operator manually pushes tab 162 downwardly so that the fingers 166 on the end of cross bar 160 push on the trailing edge of the film unit 12 and advance it through slot 150 into the lower portion 30 of tank 116.

As best shown in FIG. 3, the leading end of cassette 18 is inserted vertically into the mouth portion 32 just behind a short lip portion of forward wall 36 that extends above the top surfaces 169 of the guide blocks 74 and 76 having the wedge pins 156 protruding therefrom. Surfaces 169 support the cassette vertically within mouth portion 32. For and aft support is provided by the lip portion of forward wall 36 which engages the rear wall 140 of cassette 18 and a forward edge 170 of the short top wall 47 that engages the forward wall 144 of cassette 18.

When cassette 18 is located at its operative position, shown in FIG. 3, the cassette side walls are in sliding relationship with the interior surfaces 172 of the tank side walls 40 and 42. The side wall surfaces 172 serve to initially align the cassette laterally with respect to the tank so that the pins 156 will be received in slots 158 as the cassette is moved downwardly to its fully inserted position.

Advantageously, the cassette support structure at the leading end of mouth portion 32 closely conforms to the exterior surfaces of cassette 18 so as to establish a light-tight seal between the inserted cassette and the processing tank 16. Thus, when the cassette is inserted as shown in FIG. 3, cassette 18 and processor 10 cooperate to establish a light-tight environment within which the film unit 10 may be advanced from the cassette into the processing liquid in lower portion 30 without concern about the film unit being fogged by ambient light.

In operation, a film unit 12 is loaded into cassette 18 in an actinic light-excluding environment. The cassette is then mounted on a conventional camera where the dark slide 148 is moved to its open position and the film unit 12 is exposed to record a latent image therein. The dark slide 148 is moved to its closed position and the cassette 18 is transferred to processor 10.

Processor 10 is initially set up with the roller assembly 56 in its raised position out of alignment with open end 54 of the lower tank portion 30 to allow the cassette 18 to be inserted into the position shown in FIG. 3. Upon insertion of the cassette 18, the previously noted light-tight seal is established between the cassette and processor and pins 156 enter cam slots 158 to open the film withdrawal slot 150.

The operator manually pushes the pick mechanism 159 downwardly causing the film unit 12 to be advanced out of the cassette and down into the processing liquid in lower portion 30.

As previously noted, when the roller assembly 56 is raised, the film carrier hook 80 will become disengaged from detent 128 and assume its first lowered position within tank portion 30. The resilient arms 82 assume their normal retracted position thereby providing maximum spacing between the arms 82 and the carrier members 58. The bottom edge of the film unit 12 will come to rest and be supported by the foot portion 60 on each of the carrier members 58. Due to the rearward tilt of the tank, gravitational forces acting on film unit 12 will tend to preferentially locate it in overlying relation to the members 58 whereby its upper leading end is positioned to be in alignment with the bite of the rollers.

The film unit 12 remains immersed in the processing liquid for a desired interval, which may range from seconds to minutes depending on the characteristics of the film unit and processing liquid, during which the film unit absorbs some processing liquid to initiate a development and diffusion transfer process.

At the end of this interval, the cassette 18 is removed and a roller assembly 56 is manually rotated down to its operative position where it is latched and placed. The cassette 18 may be safely removed at this point in that the development process has proceeded sufficiently whereby the film unit may be exposed to ambient light without detrimental effects.

The film withdrawal process is initiated by the operator rotating the crank handle in a clockwise direction. This causes the roller 102 to rotate in a clockwise direction and the opposite roller 100 to rotate in a counterclockwise direction so that the film unit 12 may be advanced therebetween to the exterior of processor 10. In response to driving the rollers, the crank 122 rotates in a clockwise direction and engages the hook 80 on carrier 28. The carrier 28 is raised by the crank 122 causing the arms 82 to be deflected rearwardly by cams 94 thereby pressing the upper end of the film unit against carrier members 58 to assure that the upper end of the film unit is aligned with the bite of the pressure-applying rollers. As noted earlier, this may be necessary if absorption of the processing liquid causes the film unit to curl away from the align position. When crank 122 reaches its uppermost position, the carrier 28 is latched in its second position by detent 128 thereby feeding the leading end of the film unit 12 into the bite of the rollers. Continued rotation of the rollers causes the wet film unit to be advanced therebetween to withdraw it from the processing tank. The rollers also apply a compressive pressure to the film unit thereby squeegeeing or removing excess liquid therefrom.

Figure 7:
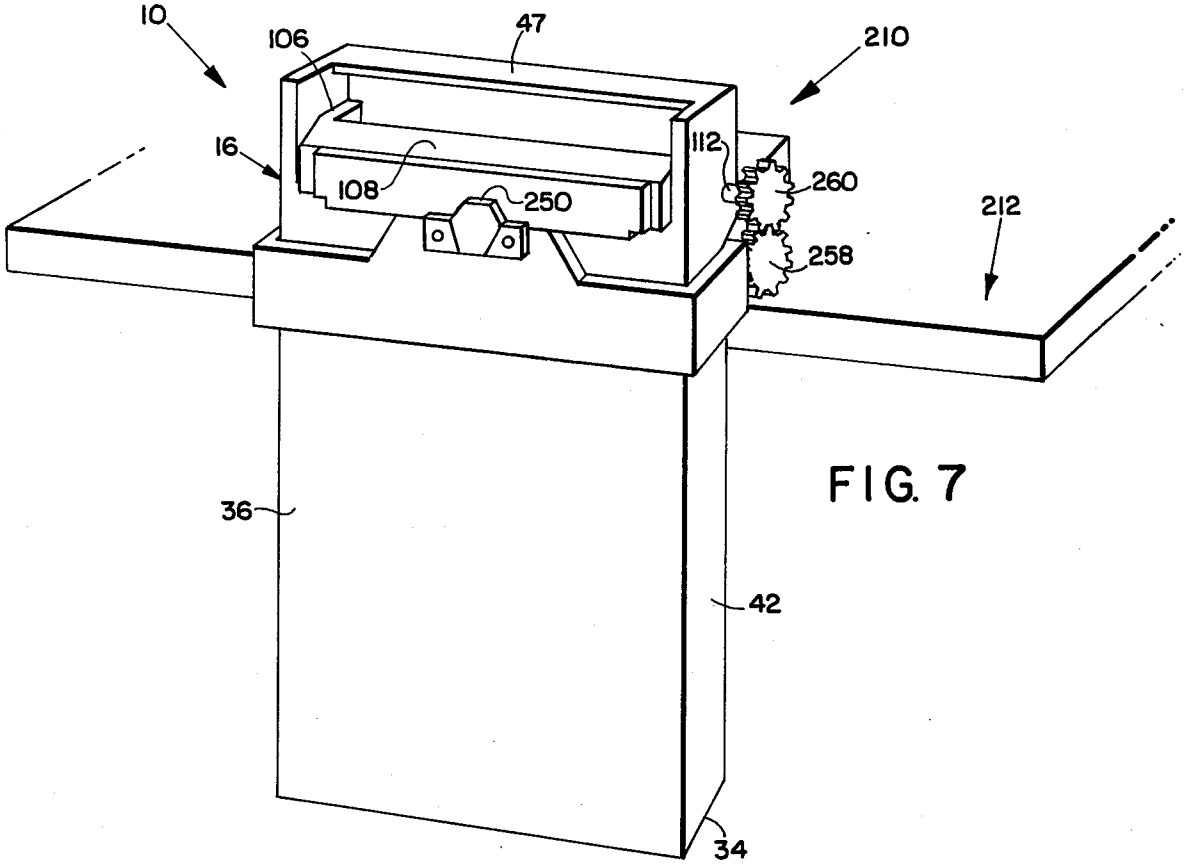
FIG. 7 perspective view of an alternative embodiment of processing apparatus.
Figure 8:
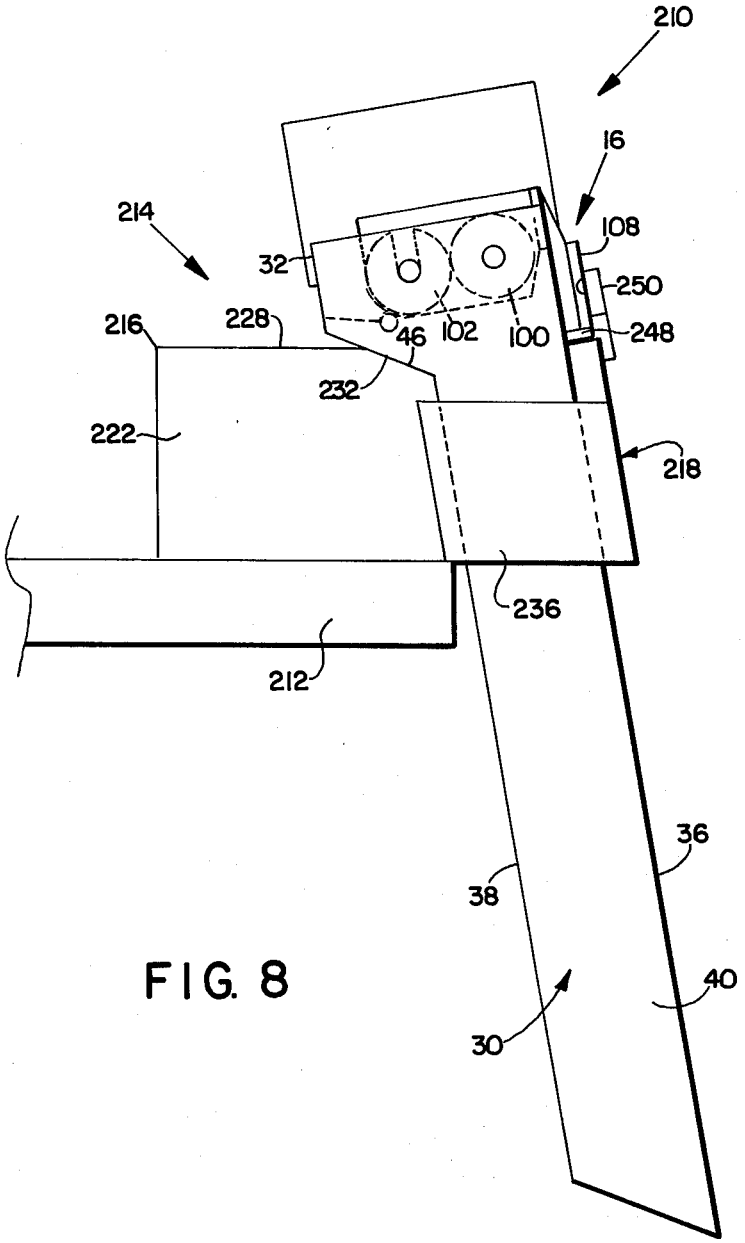
FIG. 8 is a side elevational view of the processing apparatus shown in FIG. 7.
Figure 9:
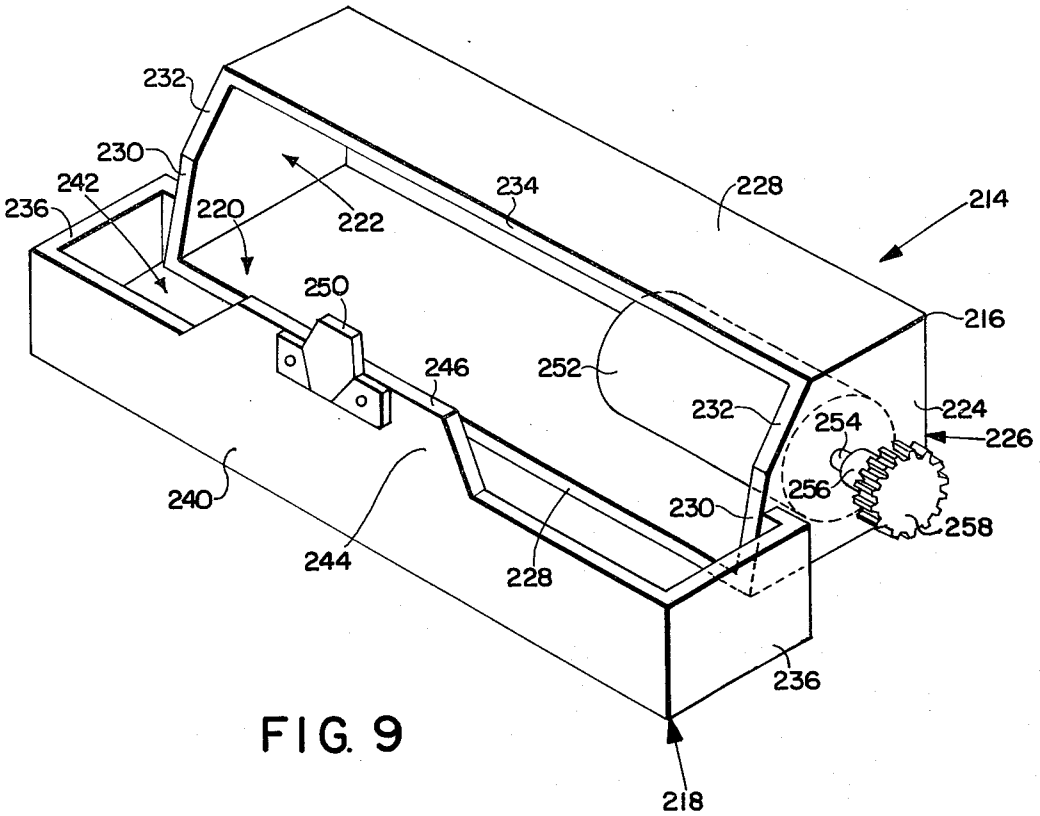
FIG. 9 is a perspective view of a tank support and motor drive component of the processing apparatus.

FIGS. 7, 8 and 9 show an alternative embodiment of the present invention in the form of a motor driven processing apparatus 210 for immersion treating of a film unit 12. In these drawings, components that are common to both embodiments carry the same numerical designations.

Processor 210 is adapted to be mounted on an end of a tabletop 212 so as to take up the minimum amount of space in a work area. Its major components include a base assembly 214 and a slightly modified version of the processor tank 16 which is removably received in and supported by base assembly 214.

Base assembly 214, as best shown in FIG. 9, includes a base housing 216 having a tank receiving collar 218 thereon.

Housing 216 is formed by a plurality of walls including a bottom wall 220, a pair of side walls 222 and 224, a rear wall 226 and top wall 228.

The forward end of housing 216 is open and edges of the various walls thereabout are shaped to conform to and engagingly support the rear side of tank 16. As shown in FIGS. 8 and 9, the leading edge 228 of bottom wall 220 and the lower forward portions 230 of side walls 222 and 224 are set at an angle A with respect to horizontal bottom wall 220 and engagingly support the rear wall 38 of tank 16. The upper portions 232 of the side walls 222 and 224 and the leading edge 234 of top wall 228 are formed at a shallower angle to conform to and engagingly support the angled transition wall 46 on the backside of mouth portion 32.

The tank receiving collar 218 is formed by a pair of L-shaped bracket members 236 attached to the leading ends of housing side walls 222 and 224 and extending forwardly therefrom to a laterally extending crossbar 240 which connects the forward ends of bracket members 236. The collar 218 and the lower forward end of housing 216 cooperate to define a generally rectangular opening 242 through which the lower tank portion 30 is inserted with the forward wall 36 of portion 30 adjacent the interior of crossbar 240.

In the illustrated embodiment, the crossbar 240 has an integrally formed raised pedestal 244 having a top support surface 246 that is engaged by a protruding lip 248 mounted on the exterior of tank forward wall 36.

In this manner, tank portion 36 is inserted into and supported on the base assembly 214. Advantageously, the tank 16 may be removed easily for cleaning or storage elsewhere when the processor 210 is not in use.

As best shown in FIG. 9, the pedestal 244 has latch member 250 thereon that mates with a complementary detent on the tank crossbar 108 for releasably latching the roller assembly 56 in its lowered operative position for receiving a film unit 12 immersed in the processing liquid in lower portion 30.

The base housing 216 is adapted to be secured to the end of tabletop 212 by any suitable means so that collar 218 projects beyond the end of the tabletop 212. For example, it may be bolted to tabletop 212 utilizing bolt holes (not shown) in bottom wall 220. Alternatively, housing 216 may be provided with bolt hole flanges about its base to facilitate mounting, or the housing 216 may be provided with a pair depending C-clamp retainers (not shown) for releasably attaching base assembly 214 to the tabletop.

The roller assembly 56 is driven by an electrical motor 252 coupled to shaft 112 of assembly 56 by means of a gear train. As best shown in FIG. 9, motor 252 is mounted in housing 216 with its output shaft 252 extending out of side wall 224. Also provided in housing 216, but not shown in the drawings, is any type of suitable conventional power supply and/or motor control unit for electrically driving motor 252. Attached to the end of shaft 252, through a one-way clutch mechanism 256, is a drive gear 258.

As best shown in FIG. 7, the axial shaft 112 of roller 102 that was driven by crank handle 114 in the previous embodiment now has a gear 260 thereon in place of the crank handle 114. When the tank 16 is inserted into its operative position in base assembly 214, gear 260 meshes with the drive gear 258.

Upon energization of motor 252, drive gear 258 is driven in a counterclockwise direction through clutch 256 thereby driving shaft 112 in a clockwise direction through gear 260 to operate the carrier raising crank 122 and drive the rollers 100 and 102 in the proper direction to withdraw the treated film unit 12. When motor 252 is not running, the clutch 256 disengages allowing the roller assembly 256 to be manually moved between its raised and lowered position without being subjected to the drag of motor 252.

In use, processor 210 functions in the same manner as the previously described processor 10. Initially, the roller assembly 56 is in its raised position and a cassette 18 holding an exposed film unit is inserted into the forward portion of the mouth 32. The wedge pins 156 open slot 150 and pick mechanism 159 is actuated to advance the film unit down into the processing liquid. Following the desired processing interval, cassette 18 is removed and roller assembly 56 is lowered manually. Then, motor 252 is energized to raise the film carrier 28 and advance the wet film unit between the pressure applying rollers 100 and 102. Although not shown in the drawings, the motorized drive assembly may be provided with conventional controls, such as timing cam operated micro switches for insuring that the rollers are driven through the proper number of revolutions to completely withdraw the film unit and that the carrier raising crank is set at its proper initial position before motor 252 is deenergized.

Since certain changes may be made in the above described processing apparatus without departing from the spirit and scope of the invention involved herein, it is intended that all matter contained in the above description or shown in the accompanying drawings shall be interpreted as illustrative and not in a limiting sense.

What is claimed is:

1. Processing apparatus for immersion treating a film unit with a processing liquid and thereafter removing excess liquid from the treated film unit, said apparatus comprising:

a processing tank configured to be filled with a volume of processing liquid sufficient to allow such a film unit to be immersed in the liquid for treatment;

a pair of rotatable pressure-applying rollers, mounted above the level of the liquid in said tank, between which the treated film unit is adapted to be advanced for removing the treated film unit from said tank and for squeegeeing excess liquid therefrom;

a movable film carrier located in said tank for movement between a first position when it receives a film unit inserted into said tank and supports the film unit at a submerged immersion treatment position within the liquid and a second position wherein it locates an end of the treated film unit above the level of the liquid and feeds it into the bite of said rollers; and means responsive to rotating said rollers in a direction to advance the film unit therebetween for effecting movement of said film carrier from said first to said second position to feed the liquid treated film unit into said rollers.

2. The processing apparatus of claim 1 wherein said tank includes an opening through which a film unit is inserted into and removed from said tank and said rollers are mounted for movement between an inoperative position wherein said rollers are out of alignment with said opening to facilitate insertion of a film unit therethrough into said tank and an operative position where said rollers are in alignment with said opening to receive a liquid treated film unit for withdrawal and squeegeeing.

3. The processing apparatus of claim 1 wherein the film unit is in a light-tight cassette prior to insertion into said tank, and said apparatus includes means at said opening for receiving an end of the cassette in light-tight relation with respect to said opening.

4. The processing apparatus of claim 1 further including cooperating means on said tank and carrier for releasably retaining said carrier at said second position.

5. The processing apparatus of claim 4 wherein said retaining means includes a hook member on said carrier and a detent on said tank.

6. The processing apparatus of claim 5 wherein said means for effecting movement of said film carrier includes a member that rotates with one of said rollers and engages said hook member to lift said carrier from said first position to said second position.

7. The processing apparatus of claim 4 wherein said rollers are mounted on said tank for movement between operative and inoperative positions and said retaining means is configured to release said carrier for movement back to said first position in response to movement of said rollers from said operative position to said inoperative position.

8. The processing apparatus of claim 1 further including means responsive to moving said carrier from said first position toward said second position for pressing a film unit against said carrier to assure that the film unit is aligned with said rollers.

9. The processing apparatus of claim 1 further including manual means for rotatably driving said rollers.

10. The processing apparatus of claim 1 further including motorized means for driving said rollers.

11. The processing apparatus of claim 1 further including a light-tight cassette for holding a film unit prior to its insertion into the liquid in the tank, and means on said tank for receiving an end of the cassette in light-tight relation with respect to said opening.

12. The processing apparatus of claim 11 wherein said cassette includes a movable pick for advancing a film unit from said cassette into the liquid in said tank.

13. The processing apparatus of claim 12 wherein said cassette includes means for defining a film entry and withdrawal slot on said cassette and at least part of said defining means are movable between a normal closed position and an open position, and said tank includes means thereon for moving said defining means from said closed to said open position in response to inserting said cassette into operative relation with said receiving means.

14. The processing apparatus of claim 1 further including a base for supporting said tank.

15. The processing apparatus of claim 14 wherein said tank is removably mounted on said base.

16. The processing apparatus of claim 14 wherein said base includes a horizontal surface configured to engage a horizontal table or desk top and said base is configured to support said tank at an angle of less than 90° with respect to said horizontal surface such that gravitation force acts on a film unit in the tank to properly position the film unit on said carrier.

17. The processing apparatus of claim 14 wherein said base includes a housing configured to be mounted on the end of a table top and a collar on said housing extending beyond the table top into which said tank is inserted for support on said base.

18. The processing apparatus of claim 17 wherein said base includes a motor mounted in said housing and said apparatus further includes means for connecting said motor in driving relation to at least one of said rollers when said tank is fully inserted into said collar.

* * * * *